United States Patent [19]

Presler et al.

[11] 4,023,372

[45] May 17, 1977

[54] MEANS TO SEAL-OFF PORTIONS OF UNDERGROUND MINES AND THE LIKE

[75] Inventors: Donald P. Presler, Millstadt, Ill.; Donald G. Didow, Florissant, Mo.

[73] Assignee: Oberjuerge Rubber Company, St. Louis, Mo.

[22] Filed: Apr. 17, 1975

[21] Appl. No.: 568,993

[52] U.S. Cl. ..... 61/45 R; 49/34; 52/2; 98/50

[51] Int. Cl.[2] ..... E21F 1/14

[58] Field of Search ..... 61/45; 98/50; 299/12; 135/14 D; 160/354; 49/34; 52/2

[56] References Cited

UNITED STATES PATENTS

| | | | |
|---|---|---|---|
| 1,478,303 | 12/1923 | Snyder | 299/12 |
| 1,766,324 | 6/1930 | Berner | 98/50 |
| 2,391,871 | 1/1946 | Benson | 160/354 X |
| 2,395,689 | 2/1946 | Sembower, Jr. | 299/12 X |
| 2,621,725 | 12/1952 | Shacikoski | 299/12 X |
| 2,826,337 | 3/1958 | Ford et al. | 9/11 A |
| 3,682,225 | 8/1972 | Redden | 135/14 D |
| 3,781,933 | 1/1974 | Soter | 9/11 A |

FOREIGN PATENTS OR APPLICATIONS

| | | | |
|---|---|---|---|
| 551,444 | 1/1958 | Canada | 135/14 D |
| 1,207,320 | 12/1965 | Germany | 52/2 |

*Primary Examiner*—Jacob Shapiro
*Attorney, Agent, or Firm*—Charles B. Haverstock

[57] ABSTRACT

An apparatus for sealably closing off or separating portions of a mine for safety or other reasons including an inflatable member having a size and shape which corresponds substantially to the cross-sectional size and shape of a mine passage, tunnel or the like to be closed off, a device for attaching the inflatable member to the ceiling of the mine passage, said inflatable member having an inflatable peripheral portion with a closure wall or web portion extending across the space defined by the inflatable portion, a source of compressed gas and means connecting said source to the inflatable portion of the member, said source including a valve with an actuator operable to open the valve so that gas from the gas source can pass into the inflatable member when the inflatable member is suspended from the ceiling of the mine passage, and a slide fastener located in the web portion of the member and movable between a first position in which an opening is formed in the web portion for passage therethrough and a second position in which the web portion is closed to separate the portions of the mine passage on opposite sides thereof from each other.

17 Claims, 5 Drawing Figures

MEANS TO SEAL-OFF PORTIONS OF UNDERGROUND MINES AND THE LIKE

Safety is a very important consideration in all mining operations and especially in mining operations where the mining is done in underground tunnels and passages. Many mine disasters have occured due to air contamination, explosion, smoke, fire and other conditions especially conditions where the environment is incapable of supporting life or is poisoned. Loss of life often results in such cases simply because there is no known way or means for quickly and effectively isolating different portions of a mine from each other while at the same time enabling the miners and others as well as equipment to be moved from one mine portion to another quickly and with a minimum possibility for the spread of the contaminating condition. In the past, when an explosion or contaminated condition existed in one portion of a mine it often spread to other portions or throughout the mine and in so doing it adversely effected all or a greater portion of the mine than may have been necessary using the present means because there was no effective way to prevent the spread of such conditions. This also meant in the past that there was no effective way for the miners to move from a contaminated area to an uncontaminated area for safety and other reasons and because of this many miners were placed in danger or lost their lives.

The present invention offers a solution to this and other problems by providing an inflatable member which can be quickly and accurately attached in a mine at such a location as to be out of the way so that it does not interfere with normal mine operations but when the subject device is needed in emergency or otherwise, can be quickly and accurately lowered to an operative position to form a screen across the mine passage while remaining attached to the ceiling. In the lowered position it extends across the passage and can be quickly inflated using an easily operated source of gas pressure for this purpose. When the device is inflated it bears against the walls of the mine passage, or a frame provided therefor in which it is located, in such a way as to form a good sealed engagement therewith. At the same time the subject device has a web portion which extends across the space formed by the inflatable portion, and the web portion has a zipper or other like opening means which can be operated preferably from either side by a miner or other person enabling him to make an opening large enough to pass through with the device installed and inflated. This enables a person to pass from one side of the device to the other such as from a contaminated part of a mine to an uncontaminated part, and after the miner has passed through the opening he can reclose it using the same zipper means to minimize or prevent the spread of the contaminated condition. Similar devices can be installed at various locations about the mine so that the mine can be divided into a plurality of separate isolated portions as necessary or desired to provide a safe condition. The device can also be used as an air diverter, as a barrier to smoke and other undesirable conditions, as a fire barrier and it has use to some extent as an explosion attenuator or barrier.

It is therefore a principal object of the present invention to provide means for effectively isolating different portions of a mine from each other for safety and other reasons.

Another object is to provide means for closing off or blocking a passageway by means which can be quickly and accurately operated even by persons having relatively little skill and training.

Another object is to make it safer to work in underground mines, tunnels, and like places.

Another object is to provide means to close off a mine tunnel or the like by means which enable a person or persons to pass through the barrier quickly and safely.

Another object is to provide safety devices for installation in mines which do not interfere with or get into the way of normal mining operations.

Another object is to teach the construction and operation of a device for sealing off different portions of a passageway such as an underground mine passage, which means are relatively inexpensive to manufacture and install.

Another object is to provide means for effectively sealing a passage or the like by means which can be constructed in relatively small compact form for ease of handling, shipping and attaching to the ceiling or other surface of a mine passage, tunnel, or the like.

Another object is to provide an inflatable barrier forming device constructed of flexible material which seals itself to a structure in which it is installed when it is inflated.

Another object is to provide passage closure means which are relatively resistant to fire, moisture and other environmental and chemical conditions.

Another object is to provide means to erect a barrier which can adjust itself to the size and shape of an opening or passage in which it is installed.

Another object is to provide a barrier forming device which may include a knockdown frame construction for mounting the device in a passage to be closed or blocked thereby.

Another object is to provide a passage closure means which can be deflated and removed quickly and with a minimum amount of structural damage when it has served its purpose.

Another object is to provide an inflatable structure capable of being rolled up or folded into a relatively compact form.

Another object is to provide an inflatable barrier for installing in passages and the like which preferably is constructed of a tough yet flexible material, which grips and holds itself in place when installed so that it can withstand substantial shock waves and other pressure forces without coming loose or rupturing.

These an other objects and advantages of the present invention will become apparent after considering the following detailed specification which discloses several embodiments thereof in conjunction with the accompanying drawing wherein.

Figure 5:
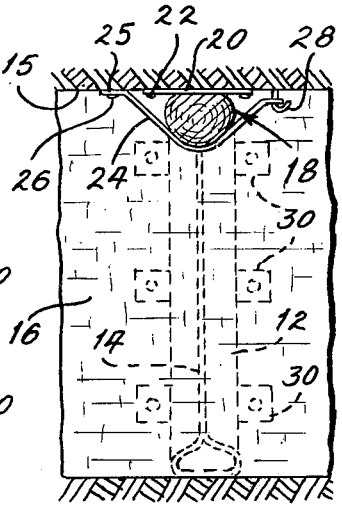
Figure 3:
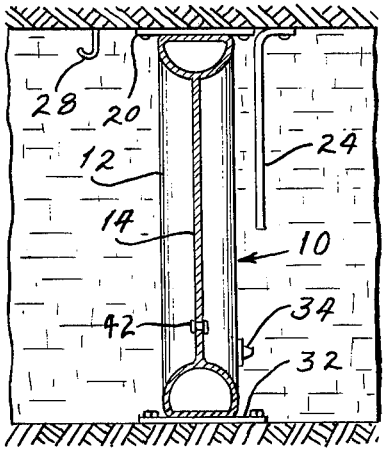
FIG. 3 is a cross-sectional view taken on line 3—3 of FIG. 2.

Referring to the drawing more particularly by reference numbers, number 10 refers to an inflatable passage closing member constructed according to the present invention. The member 10 includes a peripheral inflatable portion 12 and a web portion 14 which extends across and joins the inner periphery of the portion 12 and closes the space therebetween. The device 10 is for installing in a mine passage, a tunnel or other passage. Initially it is installed in inoperative condition by attaching it while in a rolled up or folded condition to the ceiling 15 of passage 16 as shown in solid outline at 18 in FIG. 5.

One side of the upper reach of the inflatable portion 12 has a plurality of straps or other anchoring members such as the members 20 attached thereto, and the members 20, which are preferably relatively rigid, are anchored to the ceiling 15 by suitable fasteners such as fasteners 22. The fasteners 22 can be members such as rivets or the like which are driven into the ceiling 15 using a hammer or other tool or they can be attached by using an explosive fastening device of some well known construction. In the drawing, the upper reach of the inflatable portion 12 is shown having three of the strap members 20 attached thereto although the number can be varied as necessary or desired depending on the size of the passage 16. When the member 10 is rolled up or folded and held in position adjacent to the ceiling 15 it it maintained in this position by means of one or more other straps such as the straps 24 which are shown having ends 25 anchored to the ceiling 15 by fasteners 26, and the opposite ends are attached to respective hook members 28 on the opposite side of the device 10. The straps 24 can be relatively easily released from the hooks 28 when the situation requires. When the straps 24 are in the position shown in FIG. 5 the member 10 is maintained in its rolled up or folded condition, and in this position the space in the passage 16 below the member 10 is fully open for movement through the tunnel of personnel and equipment. Furthermore, in the preferred form of the device there are no obstructions or attachments to the floor or side walls of the tunnel and foot traffic and vehicle movements are therefore not impeded.

If for some reason it is desired to close off or separate portions of the mine on opposite sides of the subject device, such as to separate portions of the mine which may be contaminated for some reason from other portions which may not be contaminated, it is a simple matter to release the straps 24 from hooks 28 so that the rolled up device 10 will fall and hang in a suspended condition from the ceiling 15 across the passage 16. This is shown in dotted outline in FIG. 5. In this position other straps or supports 30 and 32 which are attached to the member 10 in the positions shown and which may be similar to the straps 20 can be attached to the side walls and floor of the tunnel. This is preferably done before the device is inflated.

After straps 30 and 32 are attached, the hollow portion 12 of the subject device will be inflated to complete the installation. The portion 12 has one or more fittings 34 attached thereto at suitable locations such as shown, and the fitting 34 is connected by tube 36 to the outlet of a compressed gas cylinder 38. The cylinder 38 has normally closed valve means 40 of a known construction which can be easily opened to permit communication between the gas source 38 and the inside of the inflatable portion 12 through the tube 36 and the fitting 34. As the device 10 is inflated it expands or balloons outwardly into sealing engagement with the adjacent surfaces of the tunnel 16, and in so doing is able to conform itself somewhat to the size, shape and surface characteristics of the tunnel. This is desirable to isolate the passage portions on opposite sides of the device. It is also contemplated to have a similar type fitting 34 located on one or both opposite sides of the device so that it can be inflated from a position on either side for added safety reasons.

The more the pressure is increased the better will be the sealed engagement between the member 10 and the walls of the tunnel. It has been found in practice that relatively low inflation pressures are usually all that are needed, and this means that the possibilities for rupture if high inflation pressures were required, is reduced. Inflation pressures in the range from about 3 pounds per square inch (PSI) to about 10 psi have proved to be very satisfactory although higher pressures could be used if desired. Another advantage of low pressures is that it means a smaller gas supply source such as the source 38 can be used. It is recognized, however, that higher inflation pressures may be desirable in some situations including situations where the member may be required to withstand substantial pressure differentials or shock waves including the shock waves that accompany explosions without breaking loose or rupturing.

As the device inflates the surfaces of the inflatable portion 12 become relatively stiff and rigid and this has the advantage of helping to prevent movement or shifting of the device after it has been installed. Once the device is installed it is difficult, if not impossible, to remove it without first relieving or deflating the pressure in the inflatable portion 12. In the inflatable position just described, the portions of the tunnel on opposite sides of the device are effectively isolated from each other by the combined action of the inflatable portion 12 and the web portion 14 which extends across the opening formed therewithin.

Figure 1:
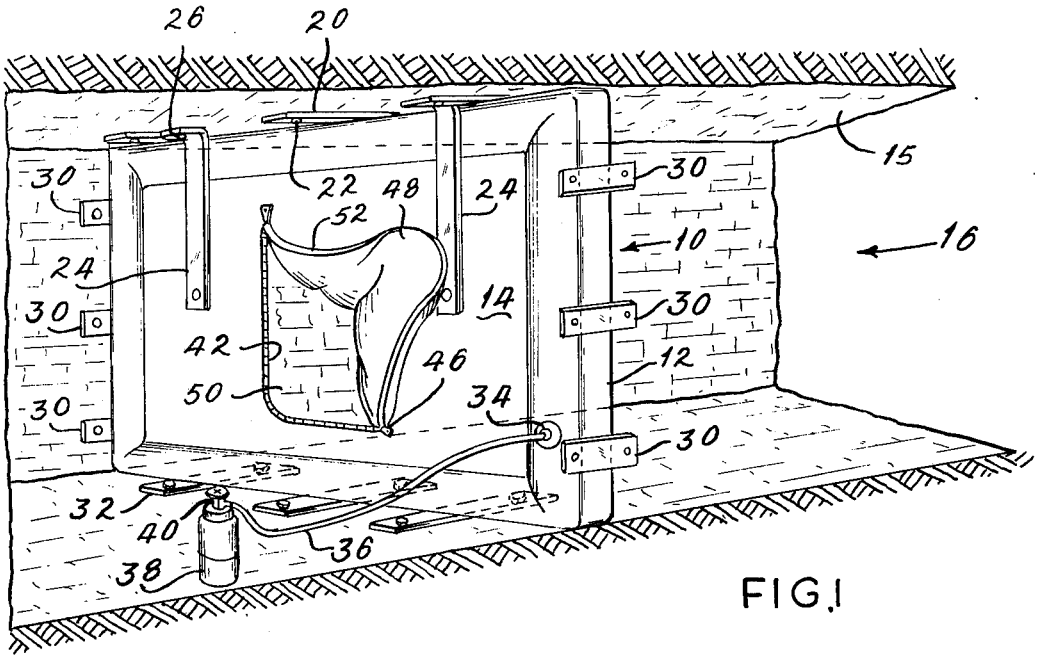
FIG. 1 is a perspective view showing a portion of a passage such as a passage in an underground mine equipped with an inflatable closure device constructed according to the present invention.
Figure 2:
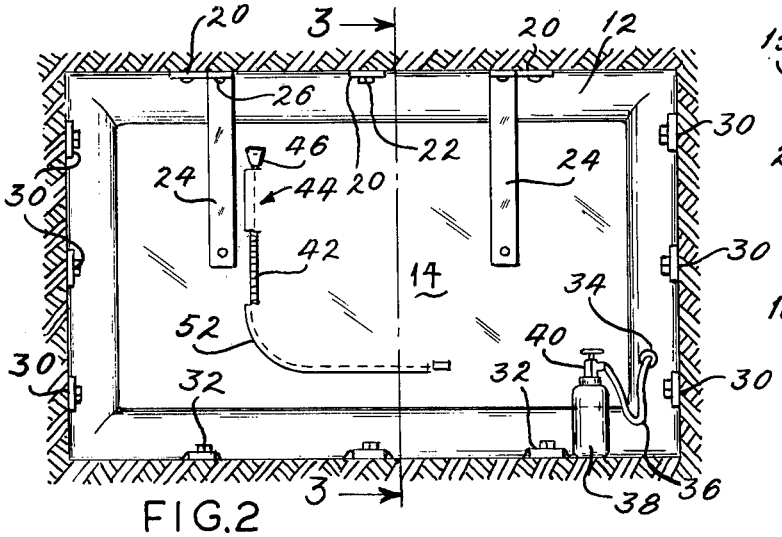
FIG. 2 is a side elevational view of the device of FIG. 1 again shown in installed condition.

The web portion 14 is preferably also flexible and is important to the device. The web 14 has a normally closed opening 42 formed in it, which opening 42 is provided with zipper means 44 including a movable zipper operator member 46 which can be moved from a closed position as shown in FIG. 2 to the open position as shown in FIG. 1. In the open position a flap 48 is formed in the web 14 by the angular relation of the portions of the zipper 44, and the flap 48 can be folded back as shown in FIG. 1 to make an opening 50 through which a person can move from one side of the device to the other. Another flap such as the flap 52 may be attached to one or both opposite sides of the web 14 in position to overlay the zipper to provide protection therefor and also to improve the seal formed at the location of the zipper. Various types of zippers or even buttons can be used for the zipper means 44 including various conventional zipper forms such as zippers having interlocking teeth members as well as zipper forms that have interlocking tongue and groove portions usually of a plastic or plastic like material.

Figure 4:
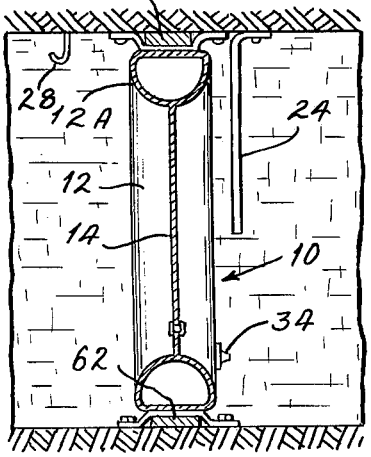
FIG. 4 is a cross-sectional view similar to FIG. 3 but showing a somewhat modified form of the present construction; and, FIG. 5 is a cross-sectional view showing the subject device in solid outline in installed but inoperative condition and in dotted outline in its installed and operative condition closing a mine passage.

FIG. 4 shows a modified form of the device wherein the inflatable portion 12A is attached to an overhead cross-member 60 which is part of a frame and is shown as being a board. Other similar frame members or boards such as frame members 62 are attached to the side and bottom walls of the opening to provide a relatively smooth surface against which the inflatable portion 12A is positioned. In some cases a frame is advantageous since it improves the sealing engagement between the members and may also facilitate positioning the inflatable means prior to and during inflation thereof. If a frame is used it is usually desirable to grout between the frame members and the adjacent surfaces of the passageway to further improve the seal therebetween. Frames, if used, can be constructed as knock-down assemblies for ease of handling and storage and the frame members can be made of wood as well as other materials including materials such as molded styrofoam where the styrofoam may be positioned on rigid support means such as on metal or wooden beams or the like. One of the disadvantages of the frame type embodiment shown in FIG. 4 is that the frame members such as the frame member 62 extends across the floor of the passage and may present an obstacle to the movement of men and equipment thereby. Frames also add to the cost and labor of installation. There still may be valid reasons to use side and top frame members even if no floor frame is used, however, and for some purposes a floor frame member is not objectionable and may actually improve the construction and operation. If a frame is to be used, it is usually preferred that it can be installed ahead of time to facilitate locating and positioning the member 10 and to make it quicker and easier to lower it into operating position, to anchor it and to inflate it.

The subject device can be constructed using many different kinds of inflatable flexible materials. One particular material that has been used successfully is a fiber reinforced rubber material. Such materials are extremely tough and durable, they are flexible without being resilient or stretchable, they are not easily torn or damaged even under relatively rough handling conditions, and they can be made to be inflated with sufficient pressure to intimately engage the walls of the passageway to tunnel so that they will not come loose. These materials can also be made to withstand relatively substantial pressure differentials or shock waves caused by explosion and other conditions without coming loose from the passage or rupturing, and if desired similar devices can be installed at spaced locations about a mine or a mine tunnel so that if one or more should break loose or rupture others will stay in place and provide the desired space separation.

Thus there has been shown and described a novel means for blocking a passage such as a passage in a mine, a tunnel or some other structure, which means fulfill all of the objects and advantages sought therefor. It will be apparent to those skilled in the art, however, that many changes, modifications, variations and other uses and applications of the subject device are possible and all such changes modifications, variations, and other uses and applications which do not depart from the spirit and scope of the invention are deemed to be covered by the invention which is limited only by the claims which follow.

What is claimed is:

1. Means to form a barrier in a passageway comprising a member formed of a relatively flexible material including a continuous hollow peripheral portion forming a border thereof of a size and shape to generally conform to the size and shape of the passageway, said peripheral portion defining an enclosed space therewithin, and said member also including a web portion extending across and closing the space defined within the hollow peripheral portion, means to support the member in a suspended position extending across the passageway at a desired location, a source of gas pressure and means for communicating said source to the hollow peripheral portion of the member to inflate said portion whereby said portion expands outwardly and bears against the surfaces of the passageway in which it is installed, the hollow peripheral portion of said member being sufficiently flexible to relatively uniformly distribute the pressure produced during expansion thereof against the passage and to form a relatively airtight connection therebetween.

2. The barrier forming means defined in claim 1 including means located in the web portion for forming an opening therein, said means including zipper-like means movable between a first positioned closing the opening and a second open position.

3. The barrier forming means defined in claim 2 wherein the zipper-like means in the web portion have two connected angularly related portions.

4. In combination with a mine passage or tunnel, means forming a barrier to prevent communication between tunnel portions on opposite sides thereof, said barrier comprising a flexible member having a continuous hollow tubular inflatable portion extending around the periphery thereof, said inflatable portion having an outer edge sized and shaped which substantially conforms to the size and shape of the passage where the barrier is installed, said hollow tubular portion having an opposite continuous inner edge, a web of flexible material connected to said continuous inner edge of the hollow portion and extending across and closing the space defined thereby within the hollow tubular portion, means in said web operable to form an opening therethrough, means including a source of gas under pressure for use in inflating the hollow tubular portion, and means to controllably communicate the gas source to the hollow tubular portion during inflation thereof, said peripheral inflatable portion being constructed of a material capable of sealably engaging and conforming to the contour of the tunnel during inflation thereof.

5. The barrier defined in claim 4 wherein the flexible member is formed of a fiber reinforced rubber-like material.

6. The barrier defined in claim 4 wherein the flexible member is relatively non-resilient.

7. The barrier defined in claim 4 wherein said means capable of forming an opening in said web include means movable in one direction to open the opening in the web, and movable in an opposite direction to close the opening.

8. The barrier defined in claim 7 including a flap normally positioned overlapping the movable means in the web when the opening therein is closed.

9. The barrier defined in claim 4 including means to anchor the outer edge of the flexible member to the adjacent walls of the passage.

10. The barrier defined in claim 4 including means to maintain the flexible member in a rolled up inoperative position adjacent to one of the walls of the passage.

11. The barrier defined in claim 4 wherein the means to controllably communicate the gas source to the hollow tubular portion include a gas fitting located on one side of the hollow tubular portion.

12. The barrier defined in claim 4 wherein the gas source is capable of inflating the hollow tubular portion to a pressure between approximately 3 and approximately 10 psi.

13. Means to form a barrier in a passageway comprising a member formed of a relatively flexible material including a hollow peripheral portion forming a border thereof of a size and shape to generally conform to the size and shape of the passageway, said peripheral portion defining an enclosed space therewithin, said member also including a web portion extending across and closing the space defined within the hollow peripheral portion, means to support the member in a position extending across the passageway at a desired location, a source of gas pressure and means communicating said source to the hollow peripheral portion of the member to inflate said portion whereby said portion expands outwardly and bears against the surfaces of the passageway in which it is installed, the expansion of the hollow peripheral portion itself causing the member to bear against the surfaces of the passageway to hold the member in place, said passageway having a ceiling, and means for attaching a preselected side edge of the member to the ceiling of the passageway.

14. Means to form a barrier in a passageway comprising a member formed of a relatively flexible material including a hollow peripheral portion forming a border thereof of a size and shape to generally conform to the size and shape of the passageway, said peripheral portion defining an enclosed space therewithin, and said member also including a web portion extending across and closing the space defined within the hollow peripheral portion, means to support the member in a position extending across the passageway at a desired location, a source of gas pressure and means communicating said source to the hollow peripheral portion of the member to inflate said portion whereby said portion expands outwardly and bears against the surfaces of the passageway in which it is installed, the expansion of the hollow peripheral portion itself causing the member to bear against the surfaces of the passageway to hold the member in place, said member having pairs of opposed outer side edges on the hollow peripheral portion and means for attaching the outer side edges of the member to the corresponding surfaces of the passageway.

15. Means to form a barrier in a passageway comprising a member formed of a relatively flexible material including a hollow peripheral portion forming a border thereof of a size and shape to generally conform to the size and shape of the passageway, said peripheral portion defining an enclosed space therewithin, and said member also including a web portion extending across and closing the space defined within the hollow peripheral portion, means to support the member in a position extending across the passageway at a desired location, a source of gas pressure and means communicating said source to the hollow peripheral portion of the member to inflate said portion whereby said portion expands outwardly and bears against the surfaces of the passageway in which it is installed, the expansion of the hollow peripheral portion itself causing the member to bear against the surfaces of the passageway to hold the member in place, and means forming a frame for attaching extending around the walls of the passageway, and means mounting the flexible member in the frame.

16. The means defined in claim 13 including means to maintain said member in an inoperative collapsed and folded condition attached to the ceiling of the passageway.

17. In a mine passage or tunnel, means to construct a barrier to prevent communication between tunnel portions on opposite sides thereof, said barrier comprising a flexible member having a hollow tubular inflatable portion extending around the periphery thereof, said inflatable portion having an outer edge sized and shaped to substantially conform to the size and shape of the passage where the barrier is to be installed, said hollow tubular portion having an opposite continuous inner edge, a web of flexible material connected to said continuous inner edge of the hollow portion and extending across the space defined thereby within the hollow tubular portion, means in said web capable of forming an opening therethrough, means including a source of gas under pressure for use in inflating the hollow tubular portion, means to controllably communicate the gas source to the hollow tubular portion during inflation thereof, and means forming a frame for mounting in the passage extending around the outer edge of the hollow tubular portion of the flexible member between said member and the adjacent walls of the passage.

* * * * *

UNITED STATES PATENT AND TRADEMARK OFFICE

CERTIFICATE OF CORRECTION

PATENT NO. : 4,023,372

DATED : May 17, 1977

INVENTOR(S) : Donald P. Presler and Donald G. Didow

It is certified that error appears in the above-identified patent and that said Letters Patent are hereby corrected as shown below:

Column 2, line 16, "passageway" should be --passage--; line 38, "a" has been added.

Column 3, line 30, "it" (second occurence) should be --is--.

Column 5, line 17, "extends" should be --extend--; line 26, "can" has been added; and line 39, "to" should be --or--.

Column 6, line 16, "positioned" should be --position--.

Signed and Sealed this sixteenth Day of August 1977

[SEAL]

Attest:

RUTH C. MASON
*Attesting Officer*

C. MARSHALL DANN
*Commissioner of Patents and Trademarks*